US009228302B2

(12) United States Patent
Lathan et al.

(10) Patent No.: US 9,228,302 B2
(45) **Date of Patent: *Jan. 5, 2016**

(54) ELONGATE PIPE-BASED TEMPORARY BRIDGE FOR SUPPORTING HEAVY LOADS

(71) Applicants: Kevin Edward Lathan, Clearwater, FL (US); Valery Tsimmerman, Brookeville, MD (US)

(72) Inventors: Kevin Edward Lathan, Clearwater, FL (US); Valery Tsimmerman, Brookeville, MD (US)

(73) Assignee: Omega Trestle LLC, Clearwater, FL (US)

( * ) Notice: Subject to any disclaimer, the term of this patent is extended or adjusted under 35 U.S.C. 154(b) by 14 days.

This patent is subject to a terminal disclaimer.

(21) Appl. No.: 14/169,781

(22) Filed: Jan. 31, 2014

(65) Prior Publication Data

US 2015/0152608 A1 Jun. 4, 2015

Related U.S. Application Data

(63) Continuation-in-part of application No. 14/095,298, filed on Dec. 3, 2013.

(51) Int. Cl.

| | |
|---|---|
| ***E01D 18/00*** | (2006.01) |
| ***E01D 19/12*** | (2006.01) |
| ***E01D 2/00*** | (2006.01) |

(Continued)

(52) U.S. Cl.

CPC *E01D 18/00* (2013.01); *E01D 2/00* (2013.01); *E01D 15/12* (2013.01); *E01D 19/125* (2013.01); *E01D 2101/10* (2013.01)

(58) Field of Classification Search

CPC ..... E01D 19/00; E01D 18/00; E01D 2/00; E01D 2/04; E04C 3/30

USPC ..... 14/77.1, 73, 74.5, 75; 405/184.5, 405/124–126, 218–221; 52/FOR. 144, 52/FOR. 136, FOR. 129, FOR. 130, 52/843–845; 249/48

See application file for complete search history.

(56) References Cited

U.S. PATENT DOCUMENTS 8,573,556 B1 * 11/2013 Baker et al. ..... 249/48

FOREIGN PATENT DOCUMENTS

| | | | |
|---|---|---|---|
| JP | 05118134 A | * | 5/1993 |
| KR | 101229472 | | 2/2013 |
| KR | 101329440 | | 11/2013 |

OTHER PUBLICATIONS

International Search Report and Written Opinion issued Mar. 23, 2015 for corresponding international PCT patent application No. PCT/US2014/068051 with an international filing date of Dec. 2, 2014.

(Continued)

*Primary Examiner* — Sunil Singh

(74) *Attorney, Agent, or Firm* — Ronald E. Smith; Nicholas Pfeifer; Smith & Hopen, P.A.

(57) ABSTRACT

A temporary bridge for supporting heavy loads includes elongate hollow cylinders. A first rigid flat plate is horizontally disposed in overlying relation to each hollow cylinder and a second rigid flat plate is horizontally disposed in underlying relation to each hollow cylinder. Stress-distributing strengthening members formed by a pair of legs that are angularly disposed with respect to one another are circumferentially positioned about each hollow cylinder and the respective free ends of the legs are secured to their associated rigid flat plates. A key extends from a first end of each hollow cylinder and a mating socket is formed in a second end of each hollow cylinder to facilitate end-to-end interconnection of a plurality of hollow cylinders. Further embodiments include longitudinally-disposed timber mats, pedestrian walkways and curvature-creating members so that the bridge may follow a nonlinear path of travel.

10 Claims, 8 Drawing Sheets

(51) Int. Cl.
*E01D 15/12* (2006.01)
*E01D 101/10* (2006.01)

(56) References Cited

OTHER PUBLICATIONS

English abstract for Korean Patent No. 10-1229472 B1 issued Feb. 7, 2013. Abstract retrieved from KIPO website, http://engpat.kipris.or.kr/engpat/searchLogina.do?next=MainSearch&checkPot=Y, on Apr. 21, 2015.

English abstract for Korean Patent No. 10-1329440 issued Nov. 14, 2013. Abstract retrieved from KIPO website, http://engpat.kipris.or.kr/engpat/searchLogina.do?next=MainSearch&checkPot=Y, on Apr. 21, 2015.

* cited by examiner

ELONGATE PIPE-BASED TEMPORARY BRIDGE FOR SUPPORTING HEAVY LOADS

CROSS-REFERENCE TO RELATED APPLICATIONS

This application is a continuation-in-part of U.S. patent application Ser. No. 14/095,298, entitled Elongate Pipe-Base Structure For Supporting Heavy Loads, and filed Dec. 3, 2013 by the same inventors. That application is incorporated herein by reference.

BACKGROUND OF THE INVENTION

1. Field of the Invention

This invention relates, generally, to temporary structures for supporting heavy loads over bodies of water or wetlands. More particularly, it relates to a modular heavy load-supporting structure having cylindrical sections that are laid end to end quickly to save time and materials.

2. Description of the Prior Art

It was a common practice before wetlands conservation was a concern to dredge out large sections of wetlands as needed when building roadways or bridges over such wetlands. Such dredging enabled barges to carry heavy equipment to the jobsite as the job site progressed across the landscape.

Over time, it became apparent that dredged wetlands were not recovering as expected, and laws now ban such dredging.

Stone causeways built in wetlands areas avoid such dredging, but they too are environmentally unacceptable.

The industry has adopted the practice of building a temporary bridge into the wetlands for the purpose of enabling heavy equipment to reach the job site. Although such bridges require pile driving, the small footprint of a pile causes no permanent damage to the wetlands, i.e., the wetlands recover quickly when the temporary piles are removed.

The primary drawback to the temporary bridge solution to the wetlands conservation problem is that such temporary bridges, since they must carry very heavy loads, can be quite expensive and time-consuming to build even though they are temporary structures that are removed when the main roadway or bridge is completed.

Thus there is a need for a temporary bridge structure that is assembled quickly from low cost materials but which can support extremely heavy loads.

There is also a need for a temporary bridge structure that is quickly disassembled as well when no longer needed.

However, in view of the art considered as a whole at the time of making the present invention, it was not obvious to those of ordinary skill in the art how the needed structure could be provided.

SUMMARY OF THE INVENTION

The long-standing but heretofore unfulfilled need for an improved structure for a temporary structure that supports heavy loads is met by a new, useful, and non-obvious invention.

The inventive structure includes at least one hollow cylinder having a longitudinal axis of symmetry and an elongate extent. In a preferred embodiment, a hollow cylinder has a thirty six inch outside diameter and a wall thickness of three-eighths of an inch. Such dimensions are preferred but are not critical because pipes of many different outside diameter and wall thicknesses can be used when building temporary bridges as disclosed herein.

A plurality of stress-distributing strengthening members is circumferentially positioned about and secured to the hollow cylinder in parallel relation to the longitudinal axis of symmetry.

The strengthening members have an extent substantially equal to the elongate extent of the elongate hollow cylinder and in the preferred embodiment each strengthening member has a generally "L" shape where the legs of the "L" are disposed in angular relation to one another. Another embodiment saves materials by providing one leg per strengthening member.

A first flat plate of rigid construction is disposed in a horizontal plane in overlying and secured relation to the hollow cylinder. A second flat plate of rigid construction is disposed in a horizontal plane in underlying and secured relation to the hollow cylinder in parallel and diametrically opposed relation to the first flat plate. The width of each flat plate may exceed but is substantially equal to the diameter of the hollow cylinder to which it is secured and the length of each flat plate is substantially equal to the length of its hollow cylinder.

In the preferred embodiment, a first pair of two-leg strengthening members is secured to a hollow cylinder on opposite sides of a vertical plane that bisects the hollow cylinder and above a horizontal plane that bisects the hollow cylinder. A second pair of two-leg strengthening members is secured to the hollow cylinder on opposite sides of the vertical plane and below the horizontal plane.

Each leg of each strengthening member of the first pair has a free end disposed in abutting and secured relation to the first rigid flat plate along the elongate extent of the first rigid flat plate. Each leg of each strengthening member of the second pair has a free end disposed in abutting and secured relation to the second rigid flat plate along the elongate extent of the second rigid flat plate.

As in the parent disclosure, an imperforate circular disc is positioned within the lumen of the hollow cylinder in perpendicular relation to the longitudinal axis of symmetry of the hollow cylinder and in longitudinally spaced relation to a preselected end of the hollow cylinder.

A first circular disc has a central opening formed therein is secured to a first end of the hollow cylinder. A second circular disc having a central opening formed therein is secured to a second, opposite end of the hollow cylinder. The central opening of the second circular disc having said central opening forms a socket that mates with a key when first and second hollow cylinder members are disposed in end-to-end abutting relation to one another along a common longitudinal axis of symmetry.

A first end of a truncate cylindrical member is secured to the imperforate cylindrical disc in concentric relation thereto and a second end protrudes through the central opening formed in the first circular disc having a central opening. The protrusion forms the key.

In a second embodiment of the invention, longitudinally disposed timbers form a timber mat.

At least one pedestrian walkway is provided in a third embodiment.

A fourth embodiment enables a non-linear connection between elongate hollow cylinders so that a temporary bridge may include at least two straight sections that are disposed at a predetermined angle relative to one another.

A fifth embodiment discloses strengthening members having only one leg.

An important object of the invention is to provide a temporary bridge structure capable of supporting extremely heavy equipment.

Another important object is to provide such a structure that can be made of any length.

Another object is to provide a structure that assembles quickly, without tight tolerances, and which is made from readily available materials.

Still further objects are to disclose a better method for building timber mats, pedestrian walkways, paths of travel having at least one angular turn, and strengthening members that save materials.

These and other important objects, advantages, and features of the invention will become clear as this disclosure proceeds.

The invention accordingly comprises the features of construction, combination of elements, and arrangement of parts exemplified in the disclosure set forth hereinafter and the claims indicate the scope of the invention.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
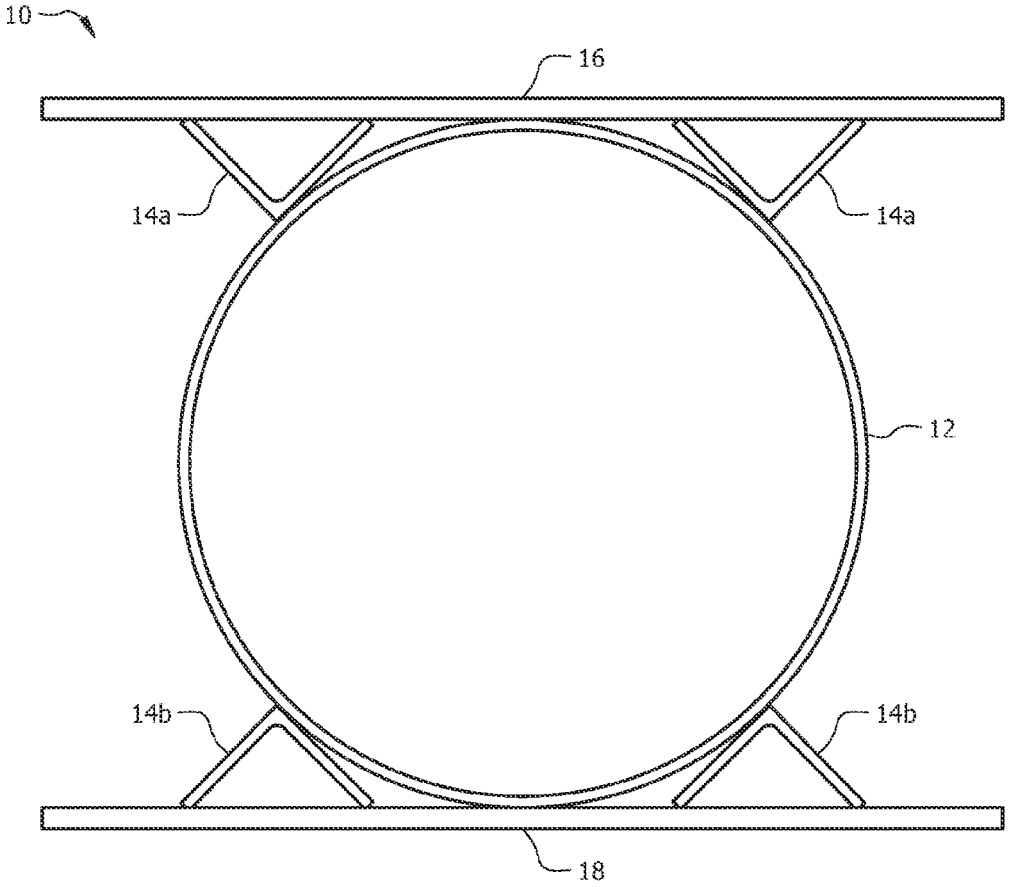
FIG. 1 is an end view of a hollow cylinder, strengthening members, and rigid flat plates used in the novel structure.

FIG. 1 depicts an illustrative embodiment of a novel structural flexural element which is denoted as a whole by the reference numeral 10.

Novel structure 10 includes elongate hollow pipe or cylinder 12 having a longitudinal axis of symmetry. Four (4) elongate, generally L-shaped stress-distributing strengthening members, denoted 14*a*, 14*a*, 14*b*, and 14*b* are circumferentially positioned about elongate hollow cylinder 12 in parallel relation to said longitudinal axis of symmetry and are secured to said elongate hollow cylinder by suitable means such as welding. The legs of each L-shaped strengthening member are disposed in angular relation to one another.

A first flat plate 16 of rectangular configuration and rigid construction overlies cylinder member 12 and the first or upper pair 14*a*, 14*a* of the strengthening members is positioned to orient said first flat plate 16 in a horizontal plane. More particularly, the free end of each leg of strengthening members 14*a*, 14*a* is welded or otherwise secured to an underside of said first flat plate. Strengthening members 14*a*, 14*a* are secured to said hollow cylinder on opposite sides of a vertical plane that longitudinally bisects hollow cylinder 12.

A second flat plate 18 of rectangular configuration and rigid construction underlies cylinder member 12 and the second or lower pair 14*b*, 14*b* of stress-distributing strengthening members 14*b*, 14*b* is positioned to orient said second flat plate 18 in a horizontal plane. More particularly, the free end of each leg of strengthening members 14*b*, 14*b* is welded or otherwise secured to a top side of said second flat plate. Strengthening members 14*b*, 14*b* are secured to hollow cylinder 12 on opposite sides of the vertical plane. Upper strengthening members 14*a*, 14*a* and lower strengthening members 14*b*, 14*b* are positioned on opposite sides of a horizontal plane that bisects hollow cylinder 12.

First and second flat plates 16 and 18 are parallel to one another in their respective horizontal planes.

Defining the end view of hollow cylinder 12 as the face of an analog clock where twelve o'clock is the highest point of said hollow cylinder as drawn in FIG. 1, upper strengthening members 14*a*, 14*a* are positioned roughly at the one and eleven o'clock positions and lower strengthening members 14*b*, 14*b* are positioned roughly at the five and seven o'clock positions.

Figure 2:
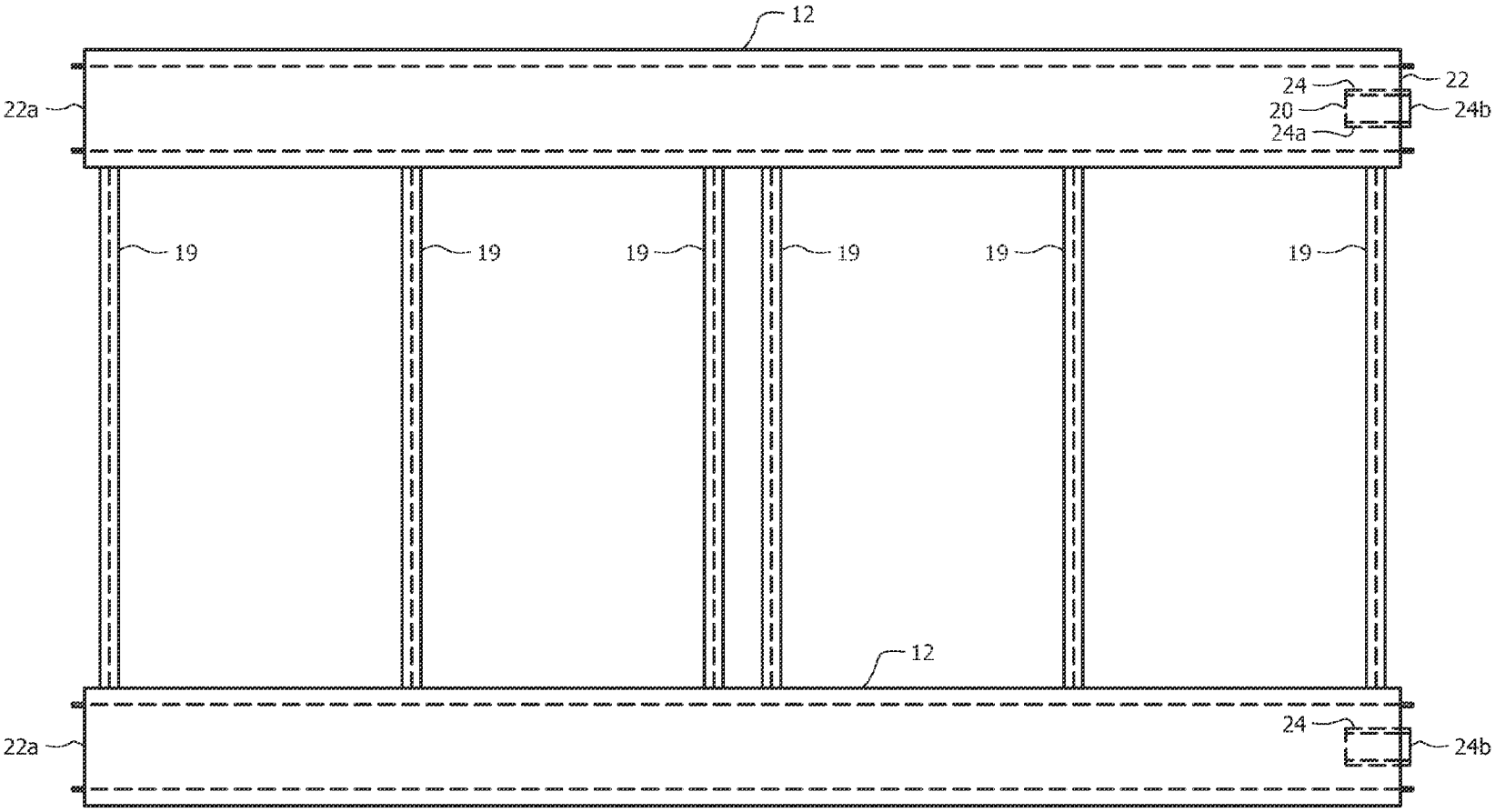
FIG. 2 is a top plan view depicting two hollow cylinders in transversely disposed relation to one another.

FIG. 2 depicts a pair of said hollow cylinders 12 disposed in transversely spaced apart, parallel relation to one another. Said cylinders are interconnected to one another along their respective extents by a plurality of transversely disposed, longitudinally spaced apart diaphragm members, collectively denoted 19.

As in the parent application, an imperforate circular disc 20 is positioned within the lumen of each hollow cylinder 12 in perpendicular relation to the longitudinal axis of symmetry of said hollow cylinder. A first circular disc 22 having a central opening 23 formed therein is secured to a first end of hollow cylinder 12. A second circular disc 22*a* having a central opening 23*a* that forms a key-receiving socket is secured to a second, opposite end of hollow cylinder 12 in closing relation thereto. No reference numeral is provided for central openings 23 and 23*a* in FIG. 2 to avoid cluttering of the drawings.

Truncate hollow cylinder member 24 has a first end 24*a* secured to imperforate circular disc 20 in concentric relation thereto, i.e., truncate cylindrical member 24 has the same longitudinal axis of symmetry as does elongate hollow cylinder 12. Second end 24*b* of truncate cylindrical member 24 extends through the central opening formed in first circular disc 22. The protrusion of second end 24*b* forms a key or pin that mates with the key-receiving socket formed in second cylindrical disc 22*a* when two (2) cylindrical members 12 are disposed in end-to-end abutting relation to one another along a common longitudinal axis of symmetry.

Thus a first or leading end of each elongate hollow cylinder 12 is provided with key or pin 24*b* as depicted in FIG. 2 and the second or trailing end of each elongate hollow cylinder is provided with a key-receiving socket in the form of said central opening formed in second circular disc 22*a*. The first and second centrally apertured circular discs 22 and 22*a*, respectively, have the same structure. The difference in reference numerals merely points out their difference in positions at opposite ends of each elongate hollow cylinder.

Figure 3:
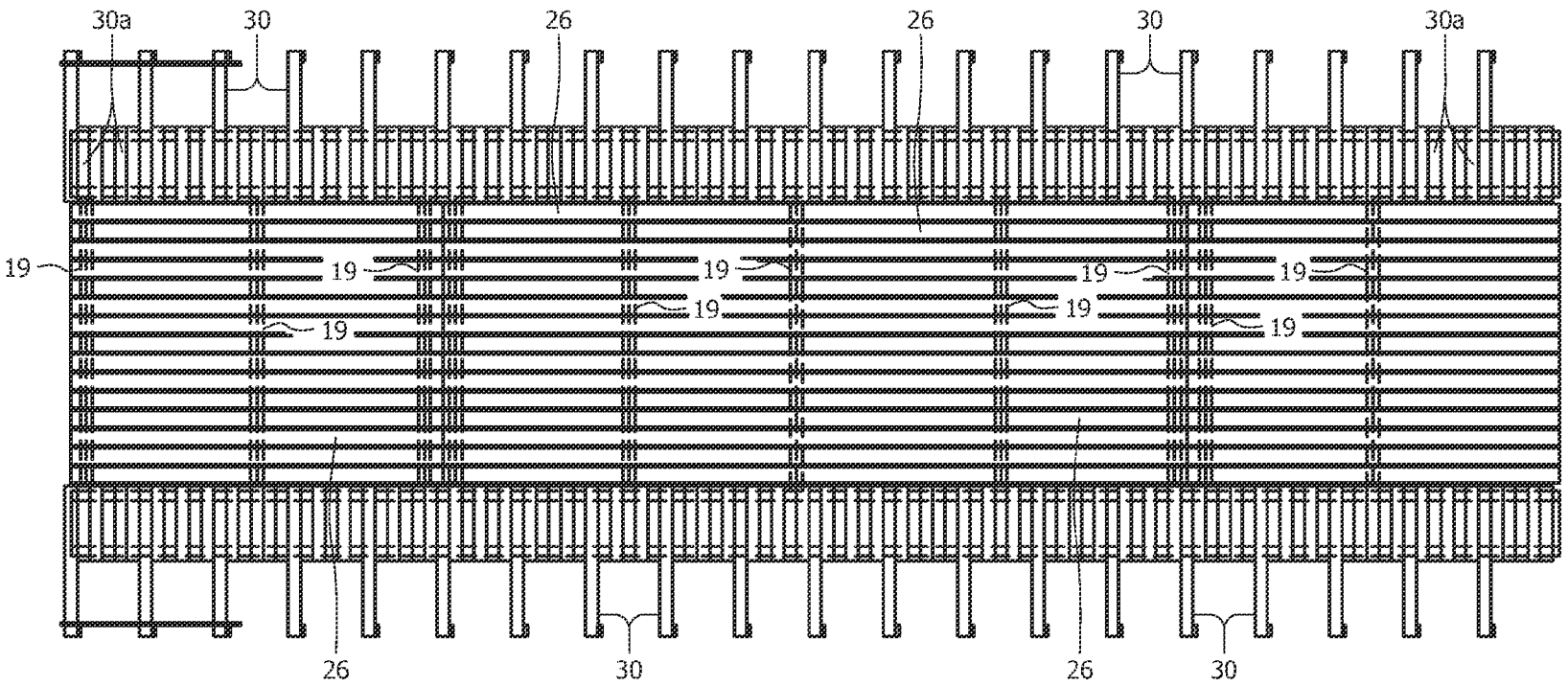
FIG. 3 is a top plan view of the FIG. 2 embodiment after longitudinally and transversely disposed timbers have been added thereto.

FIG. 3 depicts a plurality of longitudinally-disposed timbers, collectively denoted 26, supported by said transversely disposed diaphragms 19. Timbers 26 collectively form a timber mat that provides a roadway for heavy equipment. As mentioned above, all prior art timber mats are formed by a plurality of transversely disposed timbers which are supported by longitudinally disposed diaphragms which are in turn supported by transversely disposed diaphragms. The novel arrangement of FIG. 3 thus eliminates the longitudinally disposed diaphragms of the prior art.

Figure 4A:
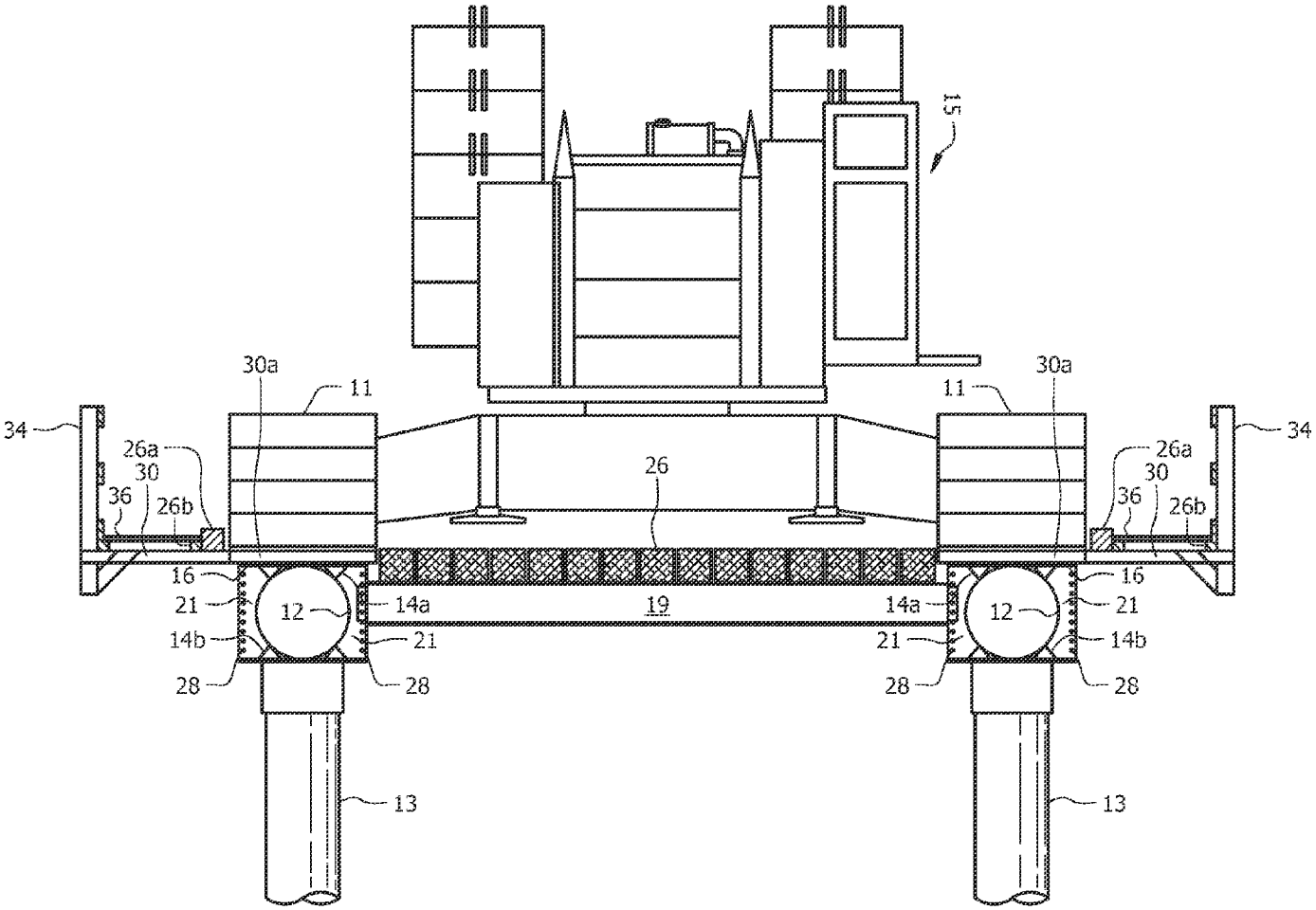
FIG. 4A is an end view of a first variation of a third embodiment.
Figure 4B:
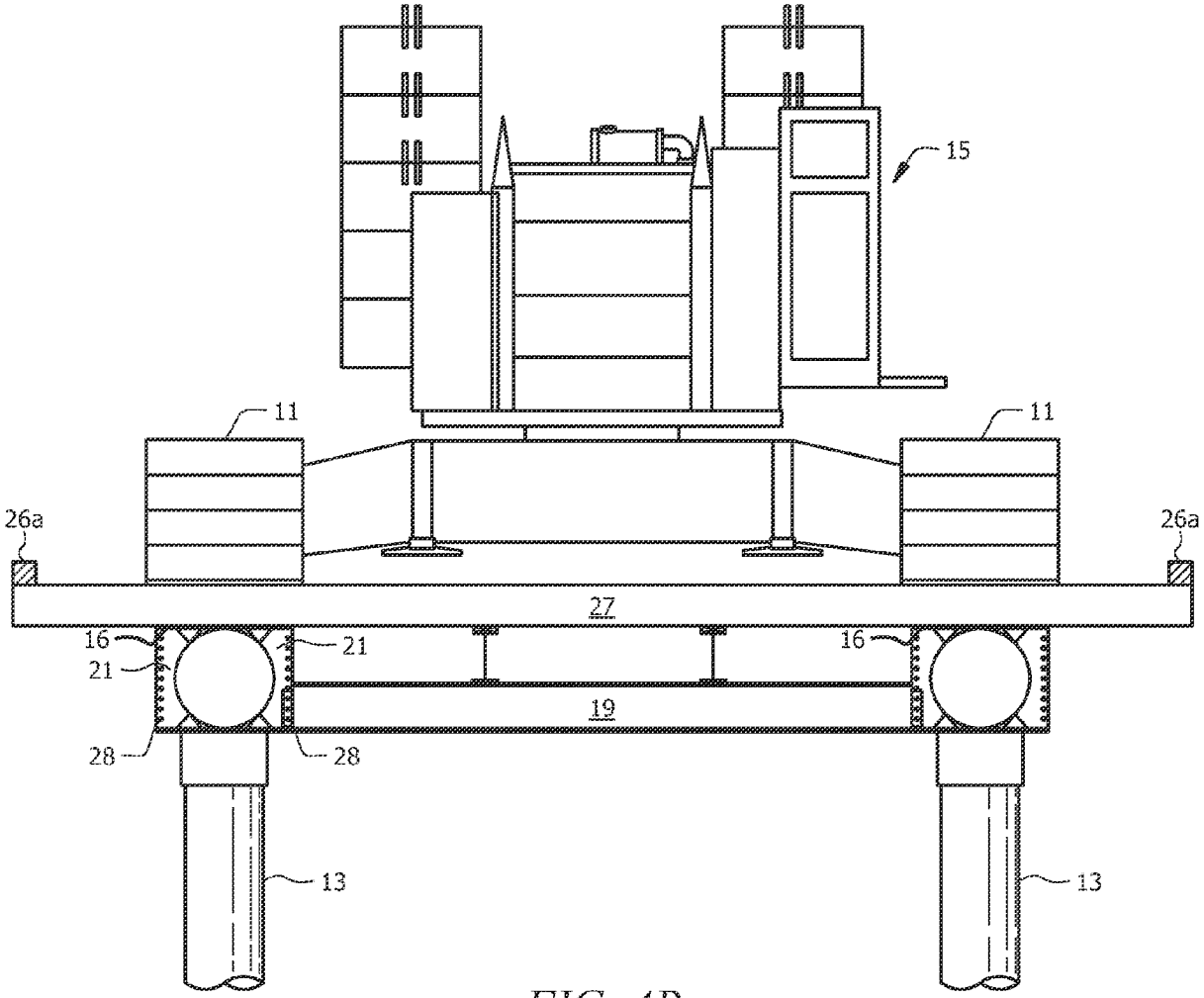
FIG. 4B is an end view of a second variation of the third embodiment.

As best understood in connection with FIGS. 4A and 4B, each diaphragm 19 is connected at its opposite ends to a flat brace 21 that is welded to its associated hollow cylinder 12 in a vertical plane. The cylinder-abutting side of each brace 21 is arcuate to conform to the surface of its associated hollow cylinder. A plurality of openings, collectively denoted 28, is formed in each brace 21 along its outboard edges and each diaphragm 19 has a plurality of openings formed in each of its ends which can be aligned with preselected openings 28. Suitable nuts and bolts are used to secure the opposite ends of each diaphragm 19 to its associated brace 21.

Such structure allows height adjustment of each diaphragm 19 along the vertical extent of its associated brace 21 and thus height adjustment of the timber mat supported by said diaphragms. The timber mat in FIG. 4B is elevated with respect to the timber mat depicted in FIG. 4A. The FIG. 4B timber mat is a prior art timber mat having transversely disposed timbers.

In the embodiment of FIGS. 3 and 4A, a pedestrian walkway is supported by a plurality of transversely disposed, longitudinally spaced apart boards, collectively denoted 30, that are mounted atop and secured to rigid flat top plate 16 in cantilever relation thereto and which extend in an outboard direction relative to each hollow cylinder 12. Elongate strips of plywood 32 or other suitable material overlie boards 30 and provide support for a pedestrian. As depicted in said FIGS. 3 and 4A, such a pedestrian walkway is provided on the outboard side of each hollow cylinder. An upstanding safety hand rail 34 is provided on the outboard side of each walkway and a longitudinally disposed timber 26*a* that is smaller than a timber mat timber 26 may be used to provide a guiding curb for the equipment as depicted in said FIG. 4A. Still smaller timbers 26*b* are used to support plywood 32.

FIGS. 3 and 4A also disclose transversely disposed shorter boards 30*a* directly overlying upper rigid flat plate 16 of their associated hollow cylinder 12 and filling in the spaces between the longer, cantilevered boards 30.

As indicated in FIG. 4A, the transverse spacing of piles 13 that support hollow cylinders 12 may be selected to directly support treads 11 of a crane 15 or other item of heavy equipment.

A pedestrian walkway may also be provided as disclosed in FIG. 4B. In this embodiment, transversely disposed, cantilevered boards 30 and the shorter boards 30*a* therebetween are not used. A plurality of transversely disposed, longitudinally spaced apart elongate timber mats 27, only one of which is depicted in the end view of FIG. 4B, is mounted and secured to the rigid flat mounting plate 16 that surmounts each hollow cylinder 12. Each of said timber mats 27 has a transverse extent that exceeds the distance between the transversely spaced apart hollow cylinders 12. The distance by which each transverse timber mat 27 extends outboard of the hollow cylinders defines the width of each pedestrian walkway. Although not depicted in FIG. 4B, a longitudinally extending strip of plywood 32 fills in the gap between timbers 27 to provide a pedestrian walkway and a suitable safety handrail may be provided as well.

The structure that enables the novel temporary bridge to turn relative to a straight line is depicted in FIGS. 5 and FIGS. 6A-D.

Figure 5:
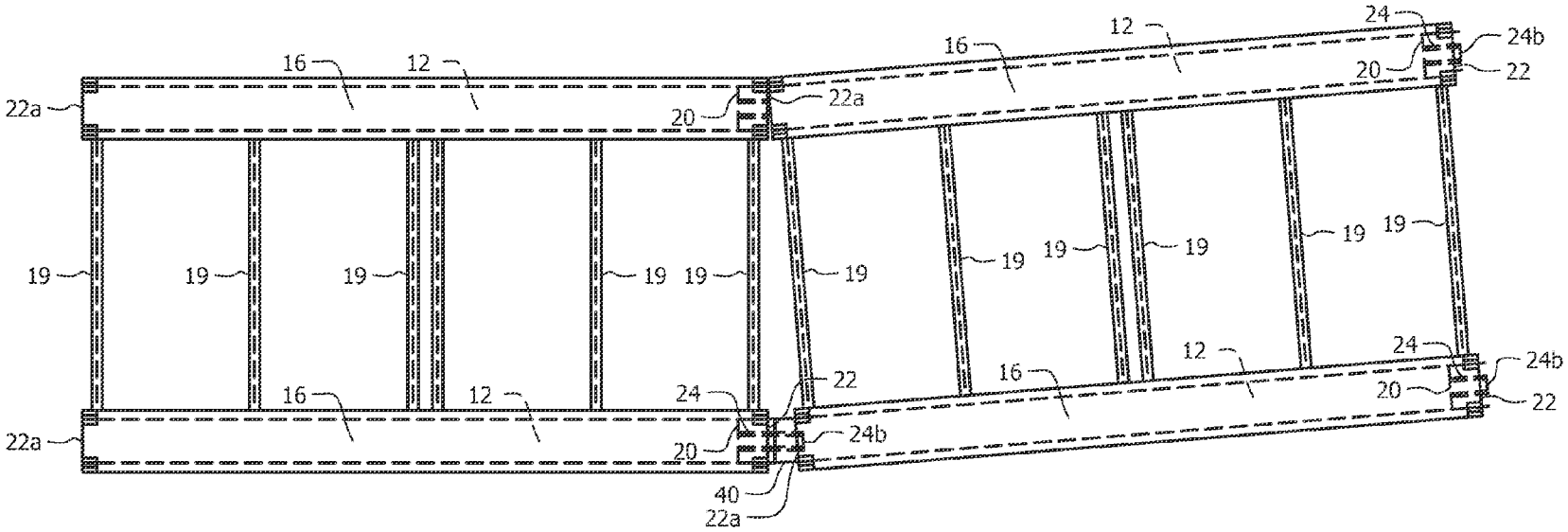
FIG. 5 is a top plan view of a fourth embodiment including a predetermined angle between two straight sections of a bridge.
Figure 6A:
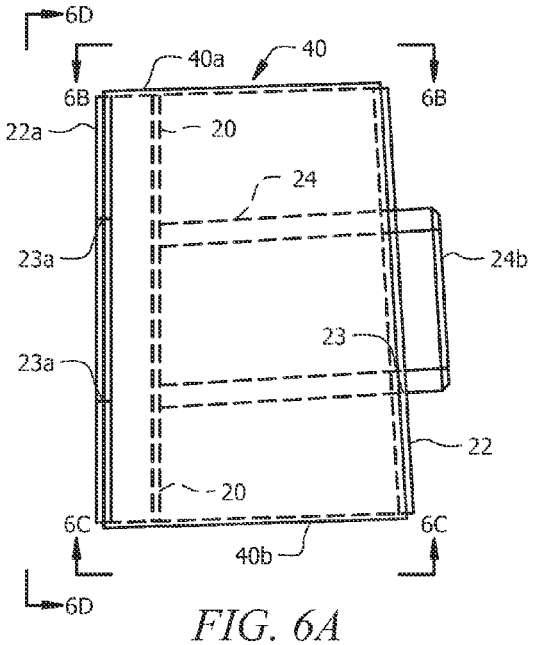
FIG. 6A is a top plan view of a truncate hollow cylinder that creates a predetermined angle between end-to-end elongate hollow cylinders.
Figure 6B:
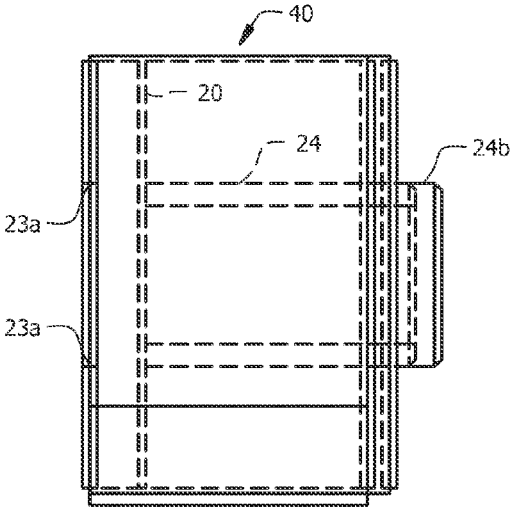
FIG. 6B is a first side elevation view of said truncate hollow cylinder, taken along line 6B-6B in FIG. 6A.
Figure 6C:
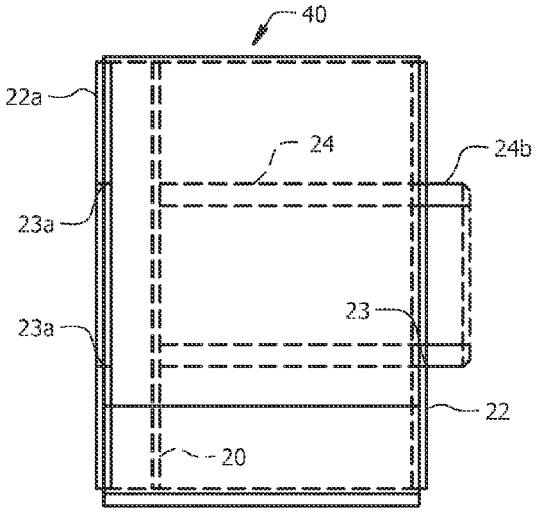
FIG. 6C is a second side elevation view of said truncate hollow cylinder, taken along line 6C-6C in FIG. 6A.
Figure 6D:
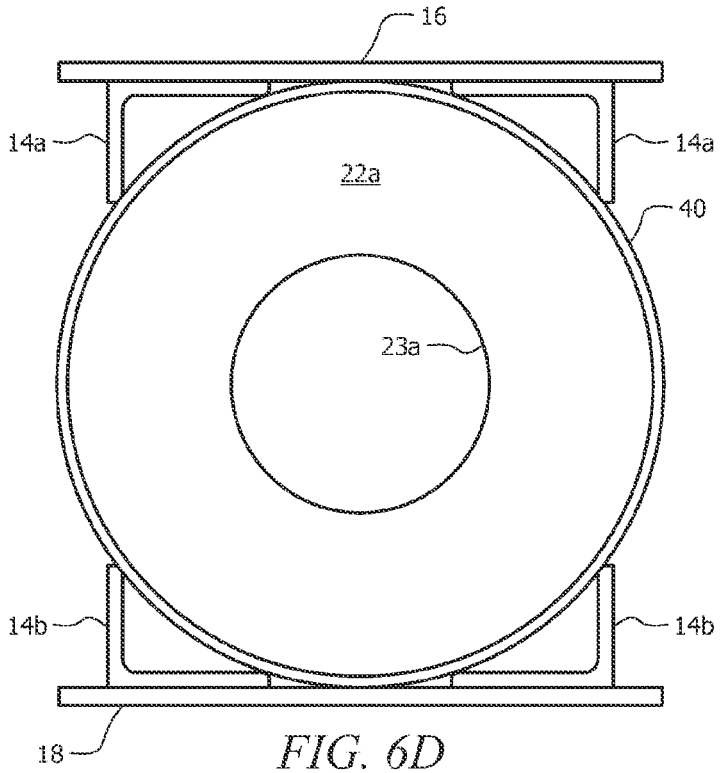
FIG. 6D is an end elevation view of said truncate hollow cylinder, taken along line 6D-6D in FIG. 6A.

FIG. 5 depicts novel turn-creating member 40 and its position between two end-to-end elongate hollow cylinders 12. Note that no such turn or curve-creating member 40 is provided between the transversely spaced associated elongate hollow cylinders 12 that are disposed end-to-end because such elongate hollow cylinders follow the interior curvature of the turn or curve and thus are not as widely spaced apart as are the elongate hollow cylinders on the outboard side of the curve.

Turn-creating member 40 is hereinafter referred to as the first or outer truncate hollow cylinder. It has a diameter equal to the diameter of each elongate hollow cylinder 12 and a structure that is much the same as the structure as each elongate hollow cylinder.

FIGS. 6A-D respectively provide top plan, first side, second side, and end views of turn or curve-creating outer truncate hollow cylinder 40.

FIG. 5 may be interpreted as depicting a turn to the left in the novel temporary bridge structure. Accordingly, the upwardly inclined (as drawn) second or inner truncate hollow cylinder 24 depicted in the top plan view of FIG. 5 and in enlarged view in FIG. 6A indicates such left turn. Similarly, first centrally-apertured circular disc 22 is disposed at an obtuse angle in FIG. 6A relative to a horizontal plane, and the left side 40*a* of member 40 has a shorter extent than right side 40*b* thereof. Moreover, said left and right sides 40*a*, 40*b* are inclined upwardly from a horizontal plane as depicted in said FIG. 6A. A member 40 for creating a right turn would include a downwardly tilted inner truncate hollow cylinder 24 in FIG. 6A and the respective lengths and inclinations of sides 40*a* and 40*b* would be reversed.

The rate of curvature is increased by employing more than one member 40 at the desired turn location. This cumulative structure is possible because each member 40 has a socket opening 23*a* formed in each centrally-apertured circular disc 22 and 22*a* and a key 24*b* that protrudes through the central opening formed in each first centrally-apertured circular disc 22.

More particularly, first or outer truncate hollow cylinder 40 is truncate relative to said elongate hollow cylinders 12, and said first truncate hollow cylinder 40 has a diameter substantially equal to a diameter of each elongate hollow cylinder 12.

A second or inner truncate hollow cylinder 24 is disposed concentrically within said first truncate hollow cylinder 40 and has a longitudinal axis of symmetry disposed at a predetermined angle relative to a longitudinal axis of symmetry of said first truncate hollow cylinder 40. Said second truncate hollow cylinder 24 therefore has a leading end disposed in oblique relation to a trailing end of said second truncate hollow cylinder.

First truncate hollow cylinder 40 is positioned between two elongate hollow cylinders 12 disposed in end-to-end relation to one another, one of which is a leading elongate hollow cylinder and one of which is a trailing elongate hollow cylinder.

As best understood in connection with FIG. 5, the trailing elongate hollow cylinder is in axial alignment with a trailing end of said first or outer truncate hollow cylinder 40 and said leading elongate hollow cylinder is in axial alignment with a leading end of said second or inner truncate hollow cylinder 24.

The predetermined angle of said second truncate hollow cylinder 24 enables construction of a temporary bridge having at least two straight sections that form an angle with one another equal to the predetermined angle of said second truncate hollow cylinder 24 with respect to the longitudinal axis of symmetry of said first truncate hollow cylinder 40.

In all other respects the structure of first or outer truncate hollow cylinder 40 is the same as each elongate hollow cylinder 12. An imperforate circular disc 20 is positioned within a lumen of first truncate hollow cylinder 40 in parallel relation to a trailing end of said first truncate hollow cylinder and in spaced apart relation to the leading end of said first truncate hollow cylinder.

A first circular disc 22 having a central opening formed therein is secured to the leading end of first truncate hollow cylinder 40 and a second circular disc 22*a* having a central opening that forms a key-receiving socket is secured to the trailing end of said first truncate hollow cylinder 40 in closing relation thereto.

Second or inner truncate hollow cylinder member 24 has a trailing end secured to said imperforate circular disc 20 in concentric relation thereto and a leading end protruding through the central opening formed in first centrally-apertured circular disc 22. The leading forms a key that engages said key-receiving socket.

Figure 7:
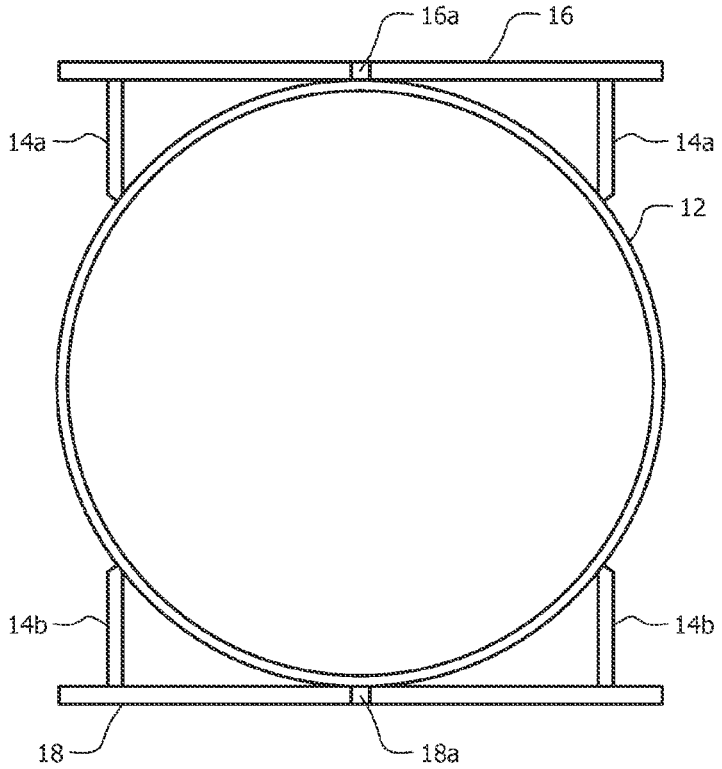
FIG. 7 is an end elevation view of a fifth embodiment.

FIG. 7 depicts an elongate hollow cylinder 12 having flat top plate 16 secured thereto in a horizontal plane and flat bottom plate 18 secured thereto in a horizontal plane. Top flat plate 16 makes tangential contact as at 16*a* with hollow cylinder 12 at the twelve o'clock position of the circle defined by said hollow cylinder 12 in end view and bottom flat plate 18 makes tangential contact as at 18*a* with hollow cylinder 12 at the six o'clock position of the circle.

Upper strengthening members 14*a*, 14*a* are formed integrally with or welded to flat top plate 16 and depend therefrom in normal relation thereto. Lower strengthening members 14*b*, 14*b* are formed integrally with or welded to flat bottom plate 18 and project upwardly therefrom in normal relation thereto.

Upper strengthening members 14*a*, 14*a* are positioned on opposite sides of the twelve o'clock point of tangential contact 16*a* in equidistantly spaced relation to said twelve o'clock point of tangential contact. Lower strengthening members 14*b*, 14*b* are positioned on opposite sides of the sic o'clock point of tangential contact 18*a* in equidistantly spaced relation to said six o'clock point of tangential contact.

This embodiment has the advantage of providing substantially as much strengthening as the above-disclosed embodiments with less materials in that each strengthening member has one leg instead of two. It has the disadvantage of requiring a more precise placement of legs 14*a*, 14*a*, 14*b*, 14*b* relative to the placement of the two leg embodiments because there are only four points of strengthening contact instead of eight.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also understood that the following claims are intended to cover all of the generic and specific features of the invention herein described, and all statements of the scope of the invention that, as a matter of language, might be said to fall therebetween.

What is claimed is:

1. A support structure, comprising:

an elongate hollow cylinder having a longitudinal axis of symmetry;

a first pair of stress-distributing strengthening members mounted to said hollow cylinder on opposite sides of a vertical plane that bisects said hollow cylinder;

a second pair of stress-distributing strengthening members mounted to said hollow cylinder on opposite sides of the vertical plane that bisects said hollow cylinder;

said first and second pairs of strengthening members disposed on opposite sides of a horizontal plane that bisects said hollow cylinder;

each of said strengthening members being generally "L"-shaped and being formed by legs that are disposed in angular relation to one another;

a first flat plate of rectangular configuration and rigid construction overlying said hollow cylinder;

a second flat plate of rectangular configuration and rigid construction underlying said hollow cylinder;

each of the legs of the first pair of strengthening members having a free end secured to an underside of said first flat plate;

each of the legs of the second pair of strengthening members having a free end secured to a top side of said second flat plate;

said first flat plate held in a horizontal plane by said first strengthening members; and said second flat plate held in a horizontal plane by said second strengthening members.

2. The support structure of claim 1, further comprising:

at least one pair of said hollow cylinders disposed in parallel, transversely spaced apart relation to one another;

said hollow cylinders being interconnected to one another along their respective extents by a plurality of transversely disposed, longitudinally spaced apart diaphragm members;

a plurality of longitudinally-disposed beams supported by said plurality of transversely disposed diaphragm members;

said plurality of longitudinally-disposed beams collectively forming a mat that provides a temporary roadway for heavy equipment.

3. The support structure of claim 2, further comprising:

a flat brace welded to each of said hollow cylinders in a vertical plane so that two flat braces are transversely opposed to one another when said pair of hollow cylinders are disposed in said parallel, transversely opposed relation to one another;

each of said diaphragms having its opposite ends secured to a flat brace.

4. The support structure of claim 3, further comprising:

each flat brace having a vertical extent so that each diaphragm can be mounted between two flat braces at differing preselected vertical adjustments.

5. The support structure of claim 4, further comprising:

a pedestrian walkway supported by a plurality of transversely disposed, longitudinally spaced apart boards of common length that are mounted atop and secured to said first flat plate of at least one of said hollow cylinders in cantilever relation thereto and which extend in an outboard direction relative to said hollow cylinders.

6. The support structure of claim 5, further comprising:

an elongate strip of pedestrian-supporting material disposed in overlying relation to said cantilevered boards.

7. The support structure of claim 6, further comprising:

a plurality of boards having a common length that is less than the common length of said cantilevered boards;

said plurality of boards disposed in directly overlying to said first flat plate on which said longer cantilever boards are mounted and performing the function of filling in spaces between said longer, cantilevered boards.

8. The support structure of claim 5, wherein the pedestrian walkway further comprises:

a plurality of transversely disposed, elongate mats mounted and secured to said first flat plate of each transversely spaced hollow cylinder in longitudinally spaced apart relation to one another; and each of said mats having a transverse extent that exceeds a distance between the transversely spaced apart hollow cylinders, said transverse extent by which said distance is exceeded extending outboard of the hollow cylinders and defining the width of said pedestrian walkway.

9. The support structure of claim 1, further comprising:

a first truncate hollow cylinder that is truncate relative to said elongate hollow cylinder, said first truncate hollow cylinder having a diameter substantially equal to a diameter of said elongate hollow cylinder;

a second truncate hollow cylinder disposed concentrically within said first truncate hollow cylinder at a predetermined angle relative to a longitudinal axis of symmetry of said first truncate hollow cylinder so that said second truncate hollow cylinder has a leading end disposed in oblique relation to a trailing end of said second truncate hollow cylinder;

said first truncate cylinder positioned between two elongate hollow cylinders disposed in end-to-end relation to one another, one of which is a leading elongate hollow cylinder and one of which is a trailing elongate hollow cylinder;

said trailing elongate hollow cylinder being in axial alignment with a trailing end of said first truncate hollow cylinder;

said leading elongate hollow cylinder being in axial alignment with a leading end of said second truncate hollow cylinder;

whereby the predetermined angle of said second truncate hollow cylinder enables construction of a temporary bridge having at least two straight sections that form an angle with one another equal to the predetermine angle of said second truncate hollow cylinder with respect to a longitudinal axis of said first truncate hollow cylinder.

10. The support structure of claim 9, further comprising:

an imperforate circular disc positioned within a lumen of said first truncate hollow cylinder in parallel relation to a trailing end of said first truncate hollow cylinder and in spaced apart relation to a leading end of said first truncate hollow cylinder;

a first circular disc having a central opening formed therein being secured to said leading end of said first truncate hollow cylinder;

a second circular disc having a central opening that forms a key-receiving socket;

said second circular disc being secured to the trailing end of said first truncate hollow cylinder in closing relation thereto;

the trailing end of said second truncate hollow cylindrical member secured to said imperforate circular disc in concentric relation thereto;

the leading end of said second truncate hollow cylindrical member protruding through the central opening formed in said first circular disc having said central opening;

said leading end of said second truncate hollow cylindrical member forming a key receivable by a key-receiving socket of another elongate hollow cylinder.

* * * * *